US010910778B2

(12) United States Patent
Ni et al.

(10) Patent No.: US 10,910,778 B2
(45) Date of Patent: Feb. 2, 2021

(54) CONDUCTIVE COAXIAL CONNECTOR

(71) Applicant: Tyco Electronics (Shanghai) Co. Ltd., Shanghai (CN)

(72) Inventors: Lin Ni, Shanghai (CN); Zhigang Song, Shanghai (CN); Jiahui Chen, Shanghai (CN); Yunhe Wang, Shanghai (CN); Songhua Liu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/295,026

(22) Filed: Mar. 7, 2019

(65) Prior Publication Data

US 2019/0280439 A1 Sep. 12, 2019

(30) Foreign Application Priority Data

Mar. 9, 2018 (CN) ..... 2018 1 0194792

(51) Int. Cl.

| | |
|---|---|
| ***H01R 13/24*** | (2006.01) |
| ***H01R 24/50*** | (2011.01) |
| ***H01R 13/405*** | (2006.01) |
| ***H01R 13/502*** | (2006.01) |
| ***H01R 13/631*** | (2006.01) |
| ***H01R 13/504*** | (2006.01) |
| *H01R 103/00* | (2006.01) |
| *H01R 12/73* | (2011.01) |

(52) U.S. Cl.

CPC ..... *H01R 24/50* (2013.01); *H01R 13/2407* (2013.01); *H01R 13/2421* (2013.01); *H01R 13/405* (2013.01); *H01R 13/502* (2013.01); *H01R 13/504* (2013.01); *H01R 13/6315* (2013.01); *H01R 12/73* (2013.01); *H01R 2103/00* (2013.01)

(58) Field of Classification Search

CPC . H01R 11/18; H01R 13/2428; H01R 13/2421

USPC ..... 439/700, 578, 824, 482

See application file for complete search history.

(56) References Cited

U.S. PATENT DOCUMENTS

| | | | |
|---|---|---|---|
| 6,758,680 B2 | 7/2004 | Duquerroy et al. | |
| 6,776,668 B1 | 8/2004 | Scyoc et al. | |
| 7,972,173 B1 * | 7/2011 | Hyzin ..... | H01R 13/2421 439/578 |

* cited by examiner

*Primary Examiner* — Phuong K Dinh

(74) *Attorney, Agent, or Firm* — Barley Snyder

(57) ABSTRACT

A connector comprises a plurality of outer conductors including a first outer conductor and a second outer conductor slidably assembled together, a plurality of center conductors disposed in the outer conductors and including a first center conductor and a second center conductor slidably assembled together, an insulation seat molded on the first outer conductor, and a first elastic element disposed outside of a portion of the outer conductors. The first outer conductor has an electrical contact pin configured to electrically contact a first electronic component. The electrical contact pin is exposed outside from a surface of the insulation seat. An end of the first elastic element abuts the insulation seat and is adapted to apply an axial thrust to the first outer conductor.

20 Claims, 6 Drawing Sheets

CONDUCTIVE COAXIAL CONNECTOR

CROSS-REFERENCE TO RELATED APPLICATION

This application claims the benefit of the filing date under 35 U.S.C. § 119(a)-(d) of Chinese Patent Application No. 201810194792.9, filed on Mar. 9, 2018.

FIELD OF THE INVENTION

The present invention relates to a connector and, more particularly, to a radio frequency (RF) coaxial connector.

BACKGROUND

A lower end of a radio frequency (RF) coaxial connector is soldered to a lower printed circuit board (PCB), and an upper end of the RF coaxial connector is in electrical contact with an upper PCB to electrically connect the PCBs. An upper outer conductor of the RF coaxial connector comprises a contact ring, which maintains electrical contact with the upper PCB by a pressure provided by an external spring. A lower outer conductor of the RF coaxial connector comprises a housing which is soldered to the lower PCB to be electrically connected with the lower PCB. The contact ring and the housing are held together by an elastic sheet. A lower portion of a center conductor of the RF coaxial connector is soldered to the lower PCB to ensure electrical connection with the lower PCB and an upper portion of the center conductor maintains electrical contact with the upper PCB by a pressure provided by an internal spring. The relative position between the center conductor and the housing is defined by an insulator.

The contact ring at the upper end of the RF coaxial connector is commonly formed as a machined component, which is relatively high in cost. In addition, the contact ring may only be in electrical contact with the upper PCB at its annular end surface, resulting in unreliable electrical contact between the contact ring and the upper PCB, and reducing the performance of the RF coaxial connector.

SUMMARY

A connector comprises a plurality of outer conductors including a first outer conductor and a second outer conductor slidably assembled together, a plurality of center conductors disposed in the outer conductors and including a first center conductor and a second center conductor slidably assembled together, an insulation seat molded on the first outer conductor, and a first elastic element disposed outside of a portion of the outer conductors. The first outer conductor has an electrical contact pin configured to electrically contact a first electronic component. The electrical contact pin is exposed outside from a surface of the insulation seat. An end of the first elastic element abuts the insulation seat and is adapted to apply an axial thrust to the first outer conductor.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
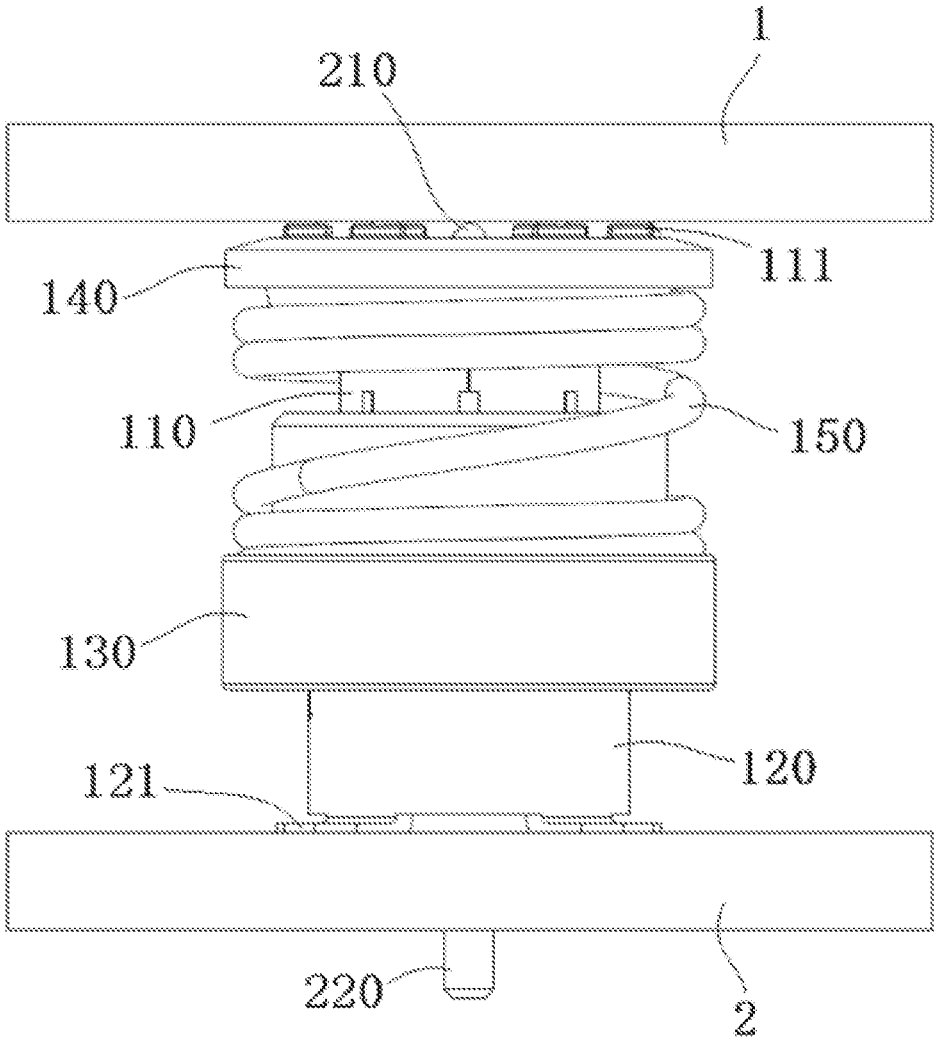
FIG. 1 is a front view of a connector according to an embodiment.

Technical solutions of the present disclosure will be described hereinafter in detail with reference to these embodiments in conjunction with the accompanying drawings, wherein the same or similar reference numerals refer to the same or similar elements. The following description of the embodiments of the present disclosure with reference to the accompanying drawings is intended to illustrate the general inventive concept of the invention, and should not be construed as limiting the invention.

In addition, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
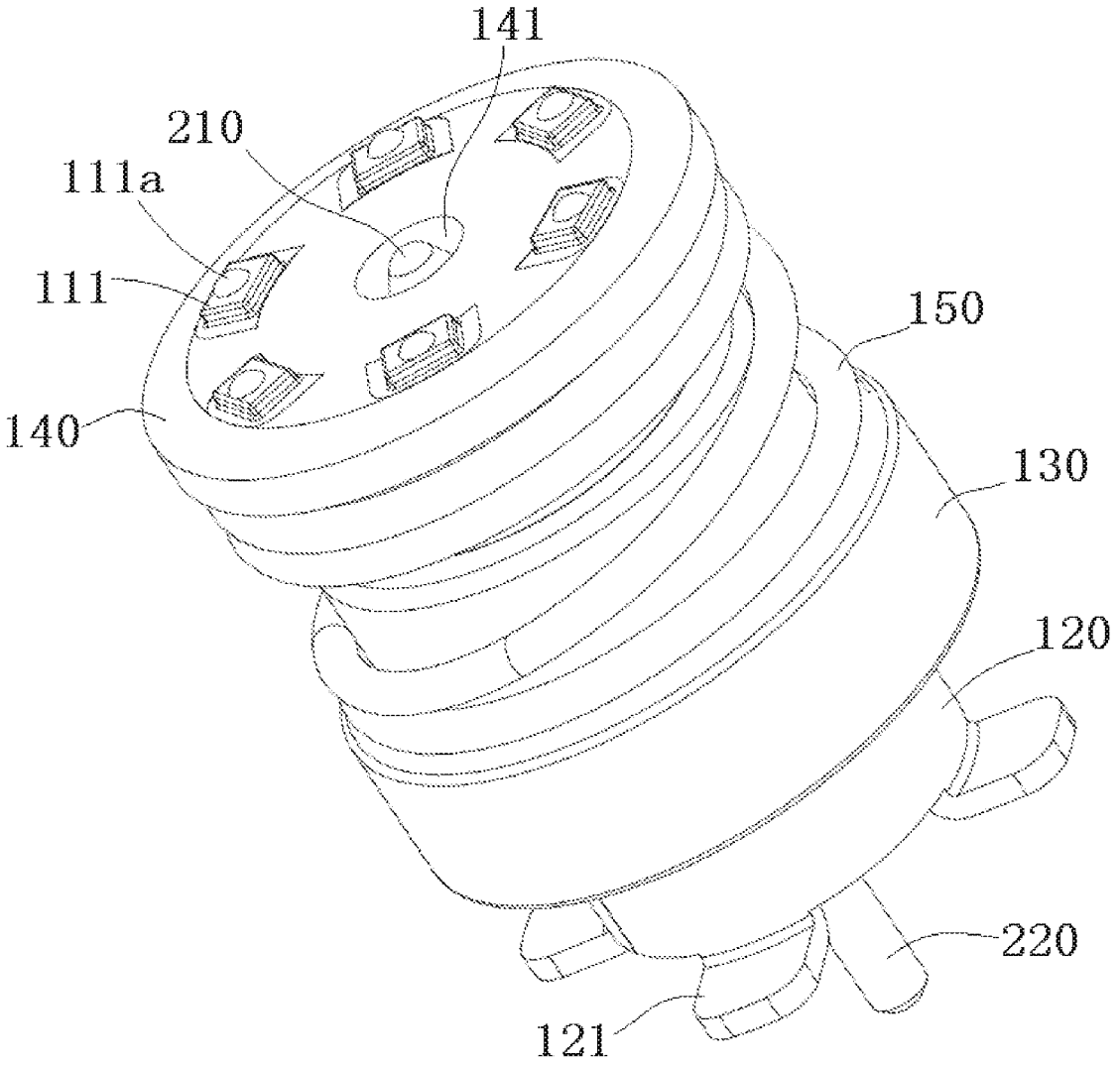
FIG. 2 is a perspective view of the connector of FIG. 1.
Figure 3:
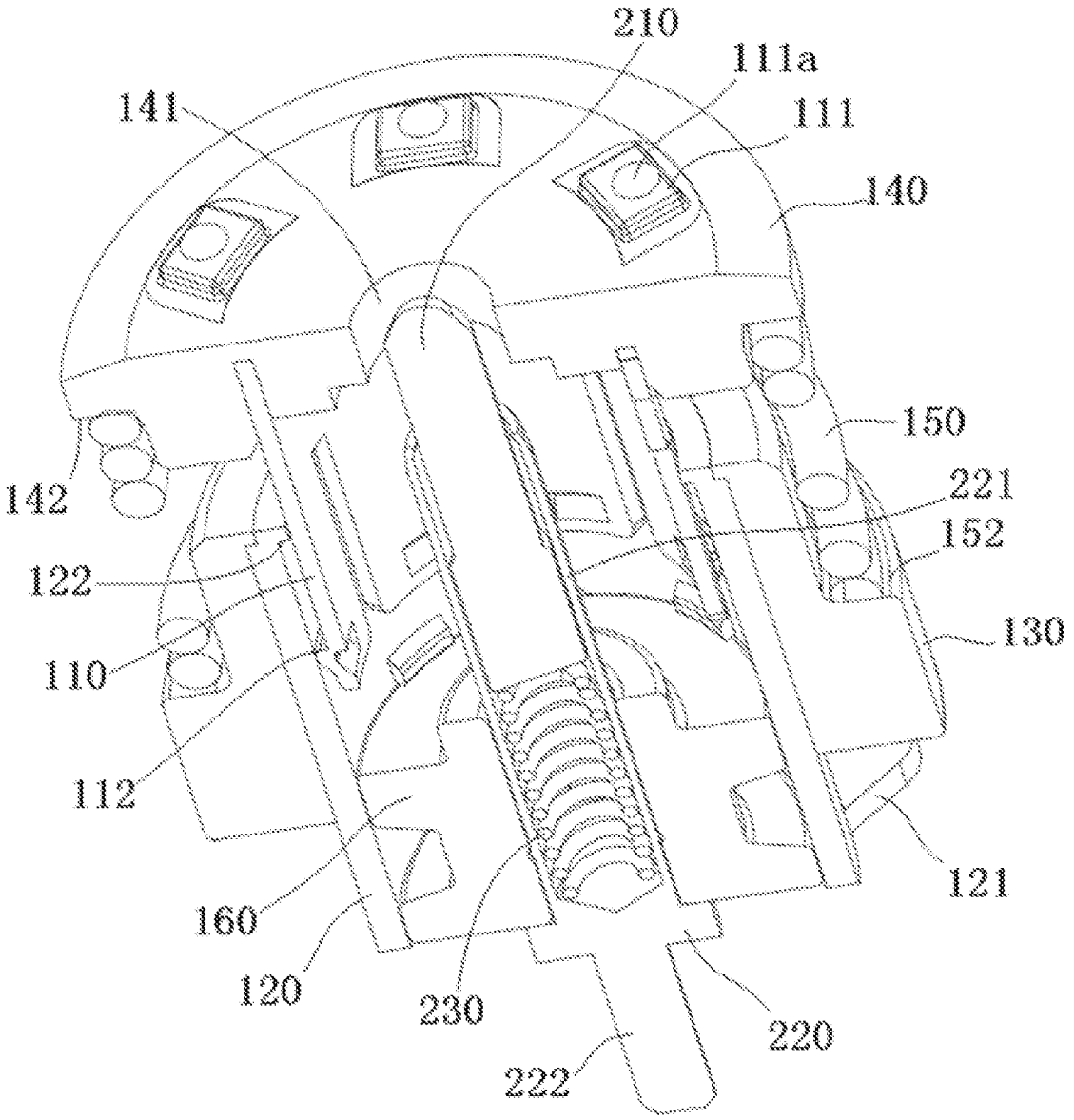
FIG. 3 is a sectional perspective view of the connector of FIG. 1.

A connector according to an embodiment, as shown in FIGS. 1-3, comprises a plurality of cylindrical outer conductors 110, 120, a plurality of columnar center conductors 210, 220, and an insulator 160. The cylindrical outer conductors 110, 120 include a first outer conductor 110 and a second outer conductor 120 which are slidably assembled together. The columnar center conductors 210, 220 are disposed in the outer conductors 110, 120 and include a first center conductor 210 and a second center conductor 220 which are slidably assembled together. The insulator 160 is disposed between the outer conductors 110, 120 and the center conductors 210, 220 and configured to hold the center conductors 210, 220 in the outer conductors 110, 120.

As shown in FIGS. 1-3, the first outer conductor 110 has a plurality of electrical contact pins 111 adapted to be in electrical contact with a first electronic component 1 and bent outwardly by substantially 90° with respect to a cylindrical body of the first outer conductor 110. A raised electrical contact 111*a*, as shown in FIGS. 2 and 3, is formed on each of the electrical contact pins 111. The electric contacts 111*a* are adapted to be in electrical contact with an electrical contact pad on the first electronic component 1.

As shown in FIGS. 1-3, the plurality of electrical contact pins 111 are evenly spaced around an outer circumference of the cylindrical body of the first outer conductor 110. In the shown embodiment, the first outer conductor 110 has six electrical contact pins 111. In another embodiment, the first outer conductor 110 may have two, three, four, five, seven or more electrical contact pins 111. In the shown embodiment, the first outer conductor 110 is formed as a single conductive component by stamping a single plate of metal, reducing the manufacturing cost of the connector.

A process of manufacturing the first outer conductor 110 according to an embodiment comprises the follows steps: first, stamping a single plate of metal to form a metal plate blank; second, bending the electrical contact pins 111 from the metal plate blank so that the electrical contact pins 111 are substantially perpendicular to a body of the metal plate blank; finally, rolling the body of the metal plate blank into a cylinder.

The connector, as shown in FIGS. 1-3, comprises a first elastic element 150 adapted to apply an axial thrust to the first outer conductor 110 such that the first outer conductor 110 is in reliable electrical contact with the first electronic part 1 by the axial thrust exerted by the first elastic element 150. The connector comprises a second elastic element 230 adapted to apply an axial thrust to the first center conductor 210 such that the first center conductor 210 is in reliable electrical contact with the first electronic component 1 by the axial thrust exerted by the second elastic element 230.

As shown in FIGS. 1-3, the connector comprises an insulation housing 130 configured to fix the second outer conductor 120 and an insulation seat 140 configured to fix the first outer conductor 110. The first elastic element 150 is compressed between the insulation housing 130 and the insulation seat 140. The insulation housing 130 is sleeved on the second outer conductor 120. A first positioning flange 152 is formed on the outside of the insulation housing 130. The first outer conductor 110 is fixed in the insulation seat 140. A second positioning flange 142 is formed on the outside of the insulation seat 140. A pair of opposite ends of the first elastic element 150 abut against the first positioning flange 152 and the second positioning flange 142, respectively. In an embodiment, because the first outer conductor 110 is fixed in the insulation seat 140, the return loss of the connector is reduced, and the performance of the connector is improved.

The insulation seat 140, as shown in FIGS. 1-3, is formed as a single insulation molded part overmolded on the first outer conductor 110 by an insert molding process. In another embodiment, the insulation seat 140 may also be formed as a separable structure. For example, the insulation seat 140 may comprise an outer insulation seat sleeved on the outside of the first outer conductor 110 and an inner insulation seat inserted in the first outer conductor 110. The first outer conductor 110 is fixed between the outer insulation seat and the inner insulation seat. A passageway 141 is formed in the insulation seat 140, an end of the first center conductor 210 passing through the passageway 141. The plurality of electrical contact pins 111 protrudes out of an outer end surface of the insulation seat 140 to be in electrical contact with the first electronic component 1.

As shown in FIGS. 1-3, an end of the first outer conductor 110 is slidably inserted into the second outer conductor 120 and is in sliding electrical contact with the second outer conductor 120. An elastic protrusion 112 protruding radially and outwardly is formed on one end of the first outer conductor 110, and a blocking protrusion 122 protruding radially and inwardly is formed on an inner wall of one end of the second outer conductor 120. The blocking protrusion 122 is engaged with the elastic protrusion 112 to prevent the first outer conductor 110 from being detached from the second outer conductor 120. The second center conductor 220 comprises a cylindrical portion 221. An end of the first center conductor 210 is slidably inserted into the cylindrical portion 221 of the second center conductor 220 and is in sliding electrical contact with the second center conductor 220.

The center conductors 210, 220, as shown in FIGS. 1-3, have a spring-typed probe structure. The second elastic element 230 is compressed within the cylindrical portion 221 of the second center conductor 220 by the first center conductor 210. A plurality of soldering pins 121 are formed on the second outer conductor 120 and adapted to be soldered to a second electronic component 2. In another embodiment, the second outer conductor 120 may be electrically connected to the second electronic component 2 by a threaded portion formed on the second outer conductor 120, the second outer conductor 120 being adapted to be screwed to the second electronic component 2 by the threaded portion. In the embodiment shown in FIGS. 1-3, the second center conductor 220 is adapted to be soldered or inserted into the second electronic component 2.

In the embodiment shown in FIGS. 1-3, the connector is a radio frequency (RF) coaxial connector adapted to electrically connect the first electronic component 1 to the second electronic component 2. In the shown embodiment, the first electronic component 1 and the second electronic component 2 are circuit boards, and the connector is a board-to-board RF coaxial connector for electrically connecting two circuit boards. The second center conductor 220 comprises a columnar insertion end 222 which may be inserted and soldered to a receptacle in the circuit board 2.

Figure 4:
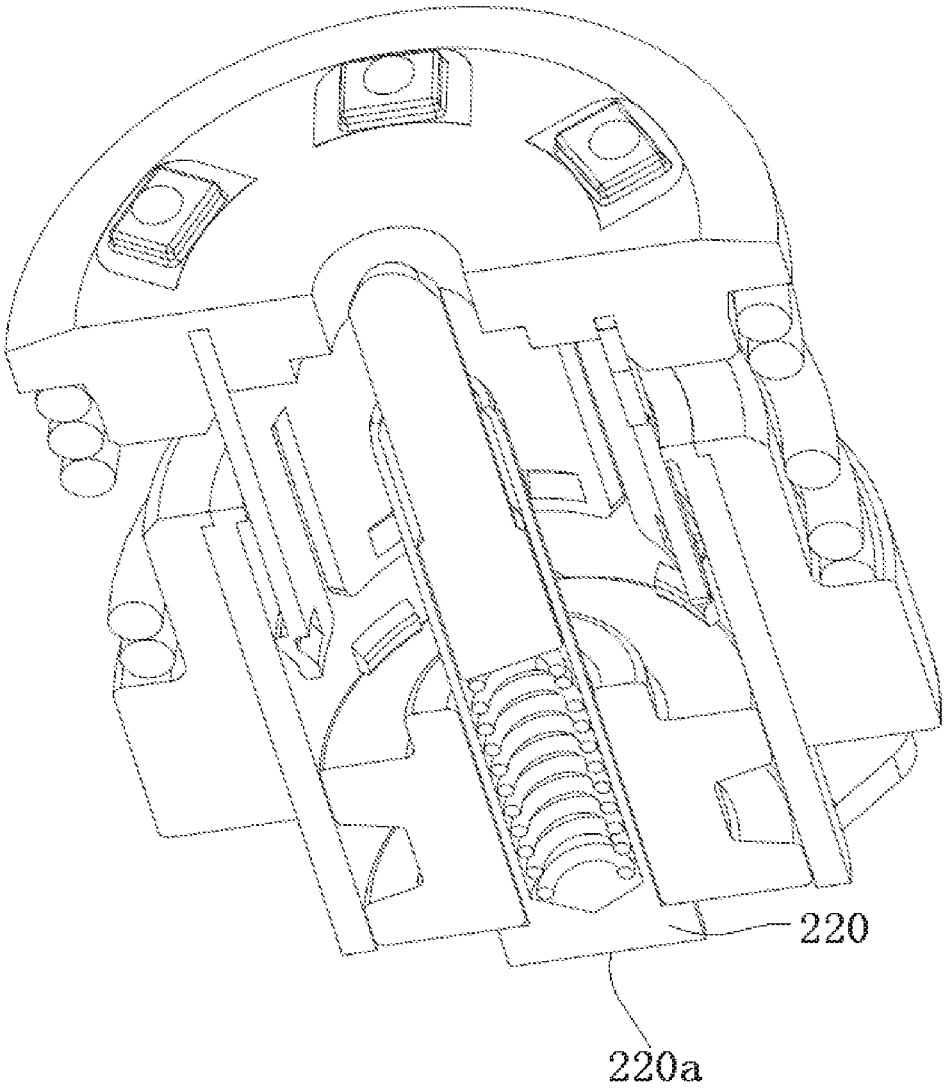
FIG. 4 is a sectional perspective view of a connector according to another embodiment.

A connector according to another embodiment is shown in FIG. 4. The connector of FIG. 4 differs from the connector shown in FIGS. 1-3 only in the structure of the second center conductor 220. In the embodiment shown in FIG. 4, the second center conductor 220 has a flat bottom surface **220*a*. The bottom surface 220*a* of the second center conductor 220 may be soldered to the surface of the circuit board 2** by Surface Mounted Technology (SMT).

Figure 5:
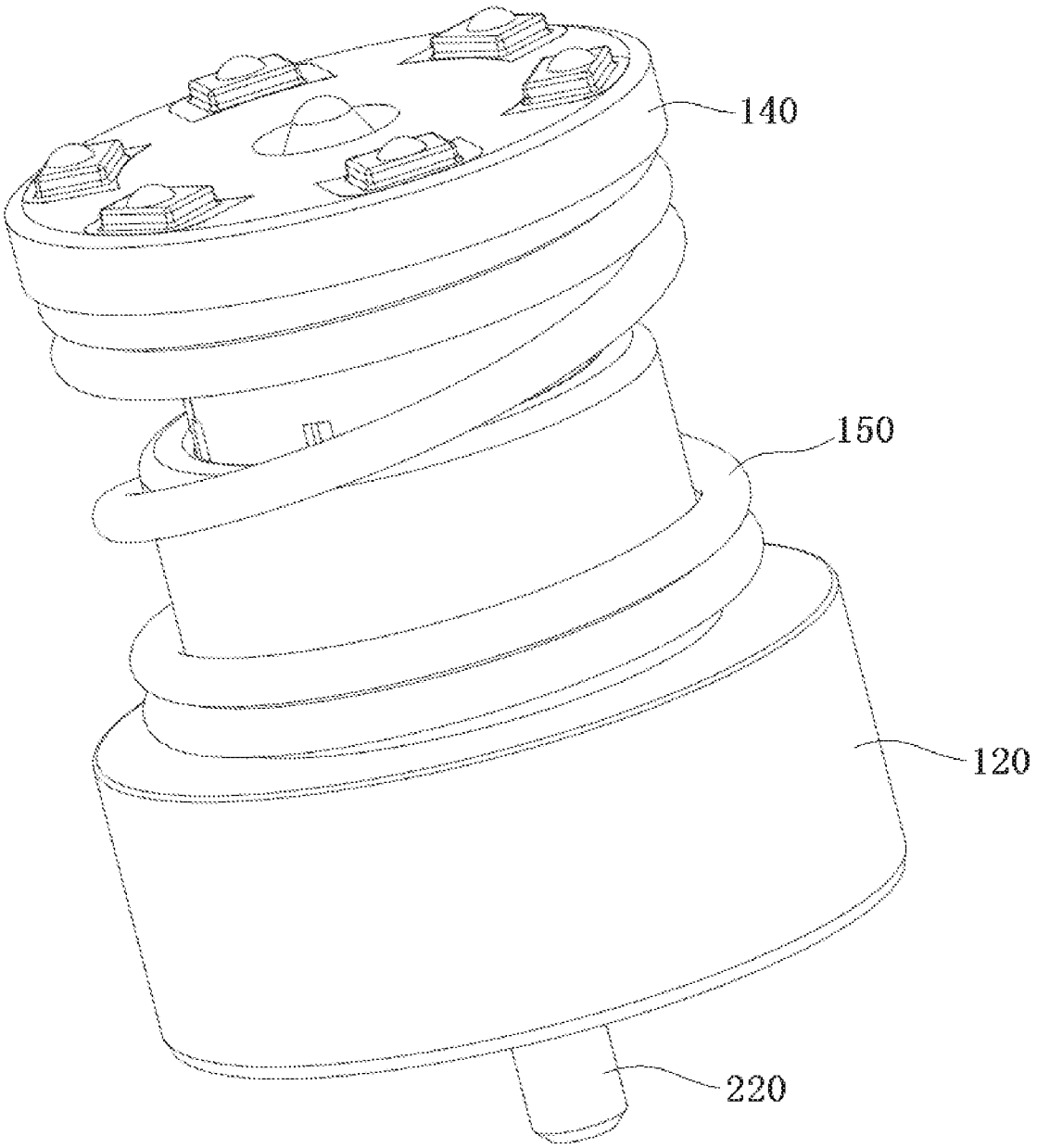
FIG. 5 is a perspective view of a connector according to another embodiment.
Figure 6:
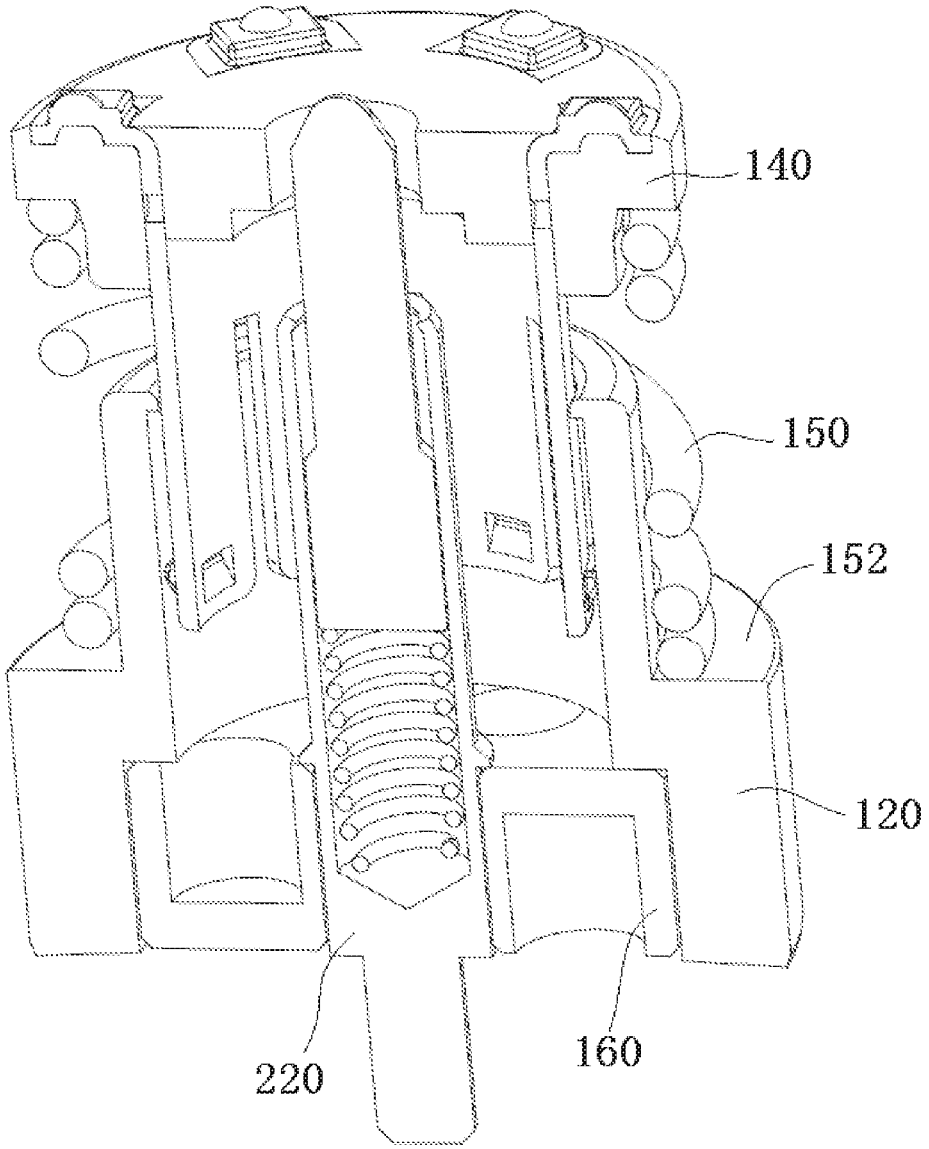
FIG. 6 is a sectional perspective view of the connector of FIG. 5.

A connector according to another embodiment, shown in FIGS. 5 and 6, is adapted to directly connect to a filter. In the connector shown in FIGS. 5 and 6, no insulation housing is provided on the outside of the second outer conductor 120. The first elastic element 150 is compressed between the second outer conductor 120 and the insulation seat 140. As shown in FIGS. 5 and 6, a first positioning flange 152 is formed on the outside of the second outer conductor 120, and a lower end of the first elastic element 150 abuts against the first positioning flange 152. In the embodiment shown in FIGS. 5 and 6, no soldering pins are formed on the second outer conductor 120, and the second outer conductor 120 comprises a flat end surface. Therefore, the second outer conductor 120 may be directly connected to the filter.

What is claimed is:

1. A connector, comprising:

a plurality of outer conductors including a first outer conductor and a second outer conductor slidably assembled together, the first outer conductor having an electrical contact pin configured to electrically contact a first electronic component;

a plurality of center conductors disposed in the outer conductors and including a first center conductor and a second center conductor slidably assembled together;

an insulation seat molded on the first outer conductor, the electrical contact pin exposed outside from a surface of the insulation seat; and a first elastic element disposed outside of a portion of the outer conductors, an end of the first elastic element abuts the insulation seat and is adapted to apply an axial thrust to the first outer conductor.

2. The connector of claim 1, further comprising an insulator disposed between the outer conductors and the center conductors, the insulator configured to hold the center conductors in the outer conductors.

3. The connector of claim 1, wherein the first outer conductor has a plurality of electrical contact pins bent outwardly by substantially 90° with respect to a cylindrical body of the first outer conductor.

4. The connector of claim 1, further comprising a second elastic element adapted to apply an axial thrust to the first center conductor, the first center conductor is in electrical contact with the first electronic component by the axial thrust exerted by the second elastic element.

5. A connector, comprising:

a plurality of outer conductors including a first outer conductor and a second outer conductor slidably assembled together, the first outer conductor having an electrical contact pin configured to electrically contact a first electronic component;

a plurality of center conductors disposed in the outer conductors and including a first center conductor and a second center conductor slidably assembled together;

an insulation seat molded on the first outer conductor, the electrical contact pin exposed outside from a surface of the insulation seat;

a first elastic element disposed outside of a portion of the outer conductors, an end of the first elastic element abuts the insulation seat and is adapted to apply an axial thrust to the first outer conductor; and an insulation housing configured to fix the second outer conductor, the insulation seat is configured to fix the first outer conductor, and the first elastic element is compressed between the insulation housing and the insulation seat.

6. The connector of claim 5, wherein the insulation housing is sleeved on the second outer conductor, a first positioning flange and a second positioning flange are formed on an outside of the insulation housing, the first outer conductor is fixed in the insulation seat, a pair of opposite ends of the first elastic element abut against the first positioning flange and the second positioning flange.

7. The connector of claim 1, wherein an end of the first outer conductor is slidably inserted into the second outer conductor and is in sliding electrical contact with the second outer conductor.

8. The connector of claim 7, wherein the end of the first outer conductor has an elastic protrusion and an inner wall of an end of the second outer conductor has a blocking protrusion, the blocking protrusion engages the elastic protrusion to prevent the first outer conductor from being disengaged from the second outer conductor.

9. The connector of claim 4, wherein the second center conductor has a cylindrical portion, an end of the first center conductor is slidably inserted into the cylindrical portion of the second center conductor and is in sliding electrical contact with the second center conductor.

10. The connector of claim 1, wherein the electrical contact pin extends through the insulation seat.

11. A connector, comprising:

a plurality of cylindrical outer conductors including a first outer conductor and a second outer conductor slidably assembled together, the first outer conductor has a plurality of electrical contact pins bent outwardly by substantially 90° with respect to a cylindrical body of the first outer conductor;

a plurality of center conductors disposed in the outer conductors and including a first center conductor and a second center conductor slidably assembled together; and an insulator disposed between the outer conductors and the center conductors and configured to hold the center conductors in the outer conductors.

12. The connector of claim 11, further comprising a first elastic element adapted to apply an axial thrust to the first outer conductor, the first outer conductor is in electrical contact with a first electronic component by the axial thrust exerted by the first elastic element.

13. The connector of claim 12, further comprising a second elastic element adapted to apply an axial thrust to the first center conductor, the first center conductor is in electrical contact with the first electronic component by the axial thrust exerted by the second elastic element.

14. The connector of claim 12, further comprising an insulation housing configured to fix the second outer conductor and an insulation seat configured to fix the first outer conductor, the first elastic element is compressed between the insulation housing and the insulation seat.

15. The connector of claim 14, wherein the insulation housing is sleeved on the second outer conductor, a first positioning flange and a second positioning flange are formed on an outside of the insulation housing, the first outer conductor is fixed in the insulation seat, a pair of opposite ends of the first elastic element abut against the first positioning flange and the second positioning flange.

16. The connector of claim 14, wherein the insulation seat includes an outer insulation seat sleeved on an outside of the first outer conductor and an inner insulation seat inserted in the first outer conductor, the first outer conductor is fixed between the outer insulation seat and the inner insulation seat.

17. The connector of claim 14, wherein an end of the first outer conductor is slidably inserted into the second outer conductor and is in sliding electrical contact with the second outer conductor.

18. The connector of claim 17, wherein the end of the first outer conductor has an elastic protrusion and an inner wall of an end of the second outer conductor has a blocking protrusion, the blocking protrusion engages the elastic protrusion to prevent the first outer conductor from being disengaged from the second outer conductor.

19. The connector of claim 13, wherein the second center conductor has a cylindrical portion, an end of the first center conductor is slidably inserted into the cylindrical portion of the second center conductor and is in sliding electrical contact with the second center conductor.

20. The connector of claim 11, wherein the connector is a radio frequency coaxial connector adapted to electrically connect a first electronic component to a second electronic component.

* * * * *